US011598590B2

(12) United States Patent
Lee

(10) Patent No.: US 11,598,590 B2
(45) Date of Patent: Mar. 7, 2023

(54) HEAT EXCHANGER

(71) Applicant: Hanon Systems, Daejeon (KR)

(72) Inventor: Duck-Ho Lee, Daejeon (KR)

(73) Assignee: Hanon Systems, Daejeon (KR)

( * ) Notice: Subject to any disclaimer, the term of this patent is extended or adjusted under 35 U.S.C. 154(b) by 205 days.

(21) Appl. No.: 17/253,846

(22) PCT Filed: Jun. 21, 2019

(86) PCT No.: PCT/KR2019/007533
§ 371 (c)(1),
(2) Date: Dec. 18, 2020

(87) PCT Pub. No.: WO2019/245334
PCT Pub. Date: Dec. 26, 2019

(65) Prior Publication Data

US 2021/0270547 A1 Sep. 2, 2021

(30) Foreign Application Priority Data

Jun. 21, 2018 (KR) ..... 10-2018-0071661
Jun. 19, 2019 (KR) ..... 10-2019-0072933

(51) Int. Cl.
*F28F 9/02* (2006.01)
*F28F 1/12* (2006.01)

(52) U.S. Cl.
CPC ..... *F28F 9/0256* (2013.01); *F28F 1/126* (2013.01)

(58) Field of Classification Search
CPC ..... F28F 1/126; F28F 9/0248; F28F 9/0246; F28F 9/0256
USPC ..... 165/173
See application file for complete search history.

(56) References Cited

U.S. PATENT DOCUMENTS 4,226,280 A * 10/1980 Hellouin de Cenival ..... F28F 9/06 29/523
9,568,225 B2 * 2/2017 Chowdhury ..... F25B 39/02
9,746,255 B2 * 8/2017 Xia ..... F28F 9/0273
10,156,498 B2 * 12/2018 Jeanson ..... G06F 30/20
10,551,099 B2 * 2/2020 Pautler ..... F28F 1/126
2009/0173482 A1 * 7/2009 Beamer ..... F28D 1/05383 165/173
2013/0168070 A1 7/2013 Samuelson
(Continued)

FOREIGN PATENT DOCUMENTS

DE 10156498 A1 * 5/2003 ..... F28D 1/0341
DE 10156498 A1 5/2003
(Continued)

OTHER PUBLICATIONS

Office Action dated Apr. 1, 2022 by the German Patent Office in the corresponding Patent Application No. DE 11 2019 003 109.0 , with English translation.

*Primary Examiner* — Claire E Rojohn, III
(74) *Attorney, Agent, or Firm* — Norton Rose Fulbright US LLP; James R. Crawford

(57) ABSTRACT

The present invention relates to a heat exchanger and, more specifically, to a heat exchanger, which has a manifold coupled to a header tank, allowing easy attachment between a manifold and a header tank as well as avoidance of interference between the manifold and a support by forming a baffle-shaped fixed baffle on one length direction of the header tank to which the manifold is inserted and attached.

10 Claims, 8 Drawing Sheets

(56) References Cited

U.S. PATENT DOCUMENTS

| | | | | |
|---|---|---|---|---|
| 2013/0312455 | A1* | 11/2013 | Jeon | F28F 9/26 62/526 |
| 2017/0158027 | A1* | 6/2017 | Lee | F25B 39/02 |
| 2017/0184474 | A1* | 6/2017 | Jeanson | E21B 47/00 |
| 2021/0262744 | A1* | 8/2021 | Leffler | F25B 39/00 |
| 2021/0270547 | A1* | 9/2021 | Lee | F28F 9/0256 |

FOREIGN PATENT DOCUMENTS

| | | | |
|---|---|---|---|
| DE | 112005000423 | T5 | 3/2007 |
| DE | 102013218174 | A1 | 4/2014 |
| JP | H06241614 | A | 9/1994 |
| JP | 2017-509854 | A | 4/2017 |
| KR | 100599338 | B1 | 7/2006 |
| KR | 10-2008-0087419 | A | 10/2008 |

* cited by examiner

HEAT EXCHANGER

CROSS REFERENCE TO RELATED APPLICATIONS

This application is a national phase under 35 U.S.C. § 371 of International Application No. PCT/KR2019/007533 filed Jun. 21, 2019, which claims the benefit of priority from Korean Patent Application Nos. 10-2018-0071661 filed on Jun. 21, 2018 and 10-2019-0072933 filed on Jun. 19, 2019. The entire contents of these applications are incorporated herein by reference in their entirety.

TECHNICAL FIELD

The present invention relates to a heat exchanger, and more particularly, to a heat exchanger in which a manifold is coupled to a header tank by forming a baffle-shaped fixing baffle at one side, in a length direction, of the header tank into which the manifold is inserted and bonded, such that the manifold and the header tank may be easily bonded to each other and interference between the manifold and a support may be avoided.

BACKGROUND ART

FIG. 1 is a diagram illustrating a partial cross-sectional view of a conventional heat exchanger 10.

Referring to FIG. 1, the conventional heat exchanger 10 includes header tanks 1 formed to be spaced apart from each other and tubes 2 each having both ends inserted and fixed between the header tanks 1, and a plurality of fins may be interposed between the tubes 2 to improve heat exchange efficiency.

In addition, the heat exchanger 10 may include supports 3 located at both ends of the header tanks 1 in a length direction on the outermost sides in a direction in which the tubes 2 are arranged and inserted into the header tanks 1 on both sides thereof in the length direction to protect the tubes 2 from the outside.

In the heat exchanger 10 disclosed therein, a manifold 4 bonded to end portions of an inlet pipe and an outlet pipe through which a heat exchange medium is introduced and discharged, respectively, at one selected side of the header tank 1 in a length direction is coupled to the one selected side of the header tank 1. In the heat exchanger 10 described above, the manifold 4 is fitted and coupled to an end cap 1-1 formed at an end of the header tank 1 to couple the manifold 4 thereto.

However, in the conventional heat exchanger 10 described above, the manifold 4 is fitted and fixed to the end cap 1-1 in a space overlapping with that in which the support 3 is inserted and coupled into the header tank 1, and thus, the support 3 is inserted and bonded into the header tank 1 after being deformed in shape, such as being bent, to avoid interference with the manifold 4.

That is, in the configuration in which the manifold 4 is fitted to the header tank 1, the support 3 is fixed in a bent state to avoid interference with the manifold 4, resulting in a problem in that there is great concern that the heat exchange medium may be leaked.

In addition, in manufacturing the support 3 having a shape for avoiding interference with the manifold 4 by bending the support 3 or the like, there is a problem in that a defect rate increases.

DISCLOSURE

Technical Problem

An object of the present invention is to provide a heat exchanger in which a manifold is coupled to a header tank by forming a baffle-shaped fixing baffle at one side, in a length direction, of the header tank into which the manifold is inserted and bonded, such that the manifold and the header tank may be easily bonded to each other and interference between the manifold and a support may be avoided.

Technical Solution

In one general aspect, a heat exchanger includes: header tanks including a first header tank and a second header tank spaced apart from each other at a predetermined distance; a core part including tubes each having both ends fixed to the first header tank and the second header tank respectively; and a manifold including an insertion portion inserted into the first header tank at one side of the first header tank in a length direction and a connection portion bonded to end portions of an inlet pipe and an outlet pipe through which a heat exchange medium is introduced and discharged respectively, wherein the first header tank includes a fixing baffle formed at one side of the first header tank in the length direction so that the insertion portion is inserted thereinto and the fixing baffle is shielded from the outside.

The fixing baffle may include: a fixing baffle body formed to be shielded from the outside; and a fixing baffle hole formed to be hollow in the fixing baffle body in the length direction of the first header tank so that the insertion portion is inserted and bonded into the fixing baffle body.

The core part may further include a support located on an outermost side in a direction in which the tubes are arranged, and inserted and coupled into the header tanks.

The support may be inserted and fixed into the header tanks on a further outward side in the length direction of the header tank than the fixing baffle.

The first header tank may further include a coupling hole formed to penetrate through the first header tank so that the fixing baffle body is inserted and bonded into the first header tank from the outside The coupling hole may be formed in a direction in which the header tanks are spaced apart from each other.

The fixing baffle body may be formed to protrude from the coupling hole to the outside.

The fixing baffle body may further include a reverse burring portion formed to extend outwardly from an outer circumference of the fixing baffle hole in the length direction of the header tank.

An end portion of the reverse burring portion may be formed to have an inner diameter gradually increasing toward an edge of the reverse burring portion so that the inner diameter of the end portion of the reverse burring portion is larger than an outer diameter of the insertion portion.

An end portion of the reverse burring portion may be formed to be curved in a direction in which the header tanks are spaced apart from each other so that an inner diameter of the end portion of the reverse burring portion is larger than an outer diameter of the insertion portion.

The fixing baffle hole may be formed to have a larger inner diameter on an inward side than on an outward side in the length direction of the header tank.

The fixing baffle body may further include a forward burring portion formed to extend inwardly from an outer circumference of the fixing baffle hole in the length direction of the header tank.

The fixing baffle hole may be formed to have a larger inner diameter on an outward side than on an inward side in the length direction of the header tank.

An end portion of the forward burring portion may be formed to have an inner diameter gradually increasing toward an edge of the forward burring portion so that the inner diameter of the end portion of the forward burring portion is larger than an outer diameter of the insertion portion.

An end portion of the forward burring portion may be formed to be curved in a direction in which the header tanks are spaced apart from each other so that an inner diameter of the end portion of the forward burring portion is larger than an outer diameter of the insertion portion.

Advantageous Effects

The heat exchanger according to the present invention is advantageous in that the manifold and the header tank can be easily bonded to each other, thereby manufacturing the firm heat exchanger, and the header tank is shielded and is bonded to the manifold using the fixing baffle having a simple shape, thereby reducing a cost and a time for manufacturing the heat exchanger.

In addition, the heat exchanger according to the present invention is advantageous in that interference between the manifold and the support can be avoided, thereby not only preventing an increase in support manufacturing cost but also minimizing leakage of the heat exchange medium to the outside.

BEST MODE

Hereinafter, the heat exchanger according to the present invention as described above will be described in detail with reference to the accompanying drawings.

First Exemplary Embodiment

Figure 1:
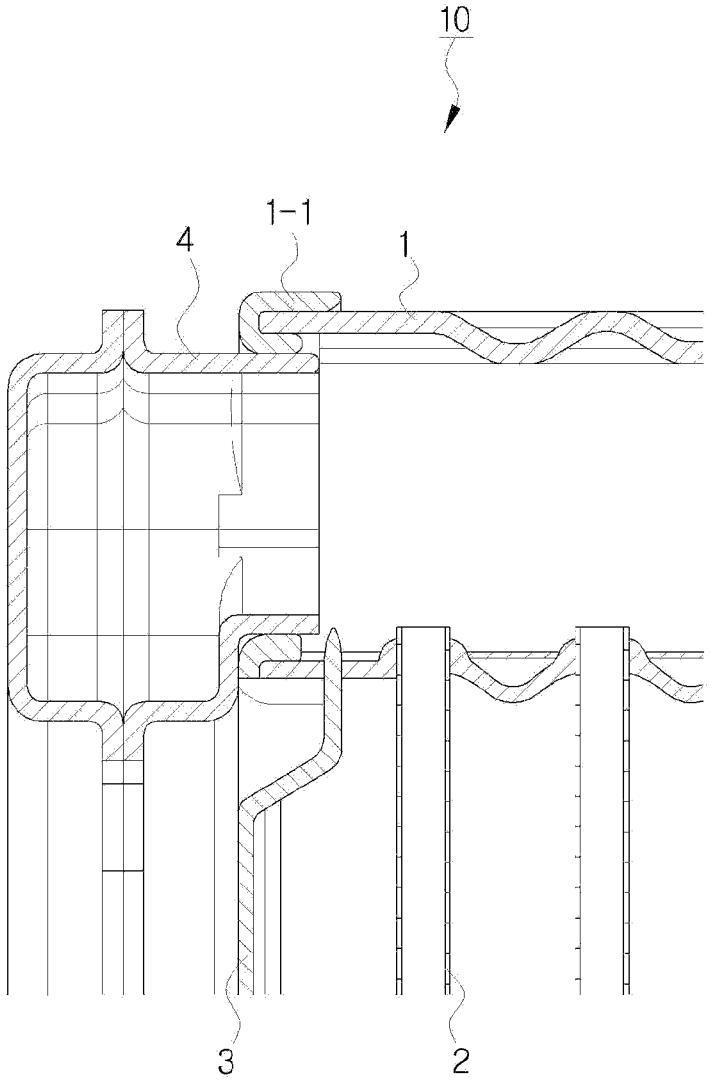
FIG. 1 is a diagram illustrating a conventional heat exchanger in a partial cross-sectional view.
Figure 2:
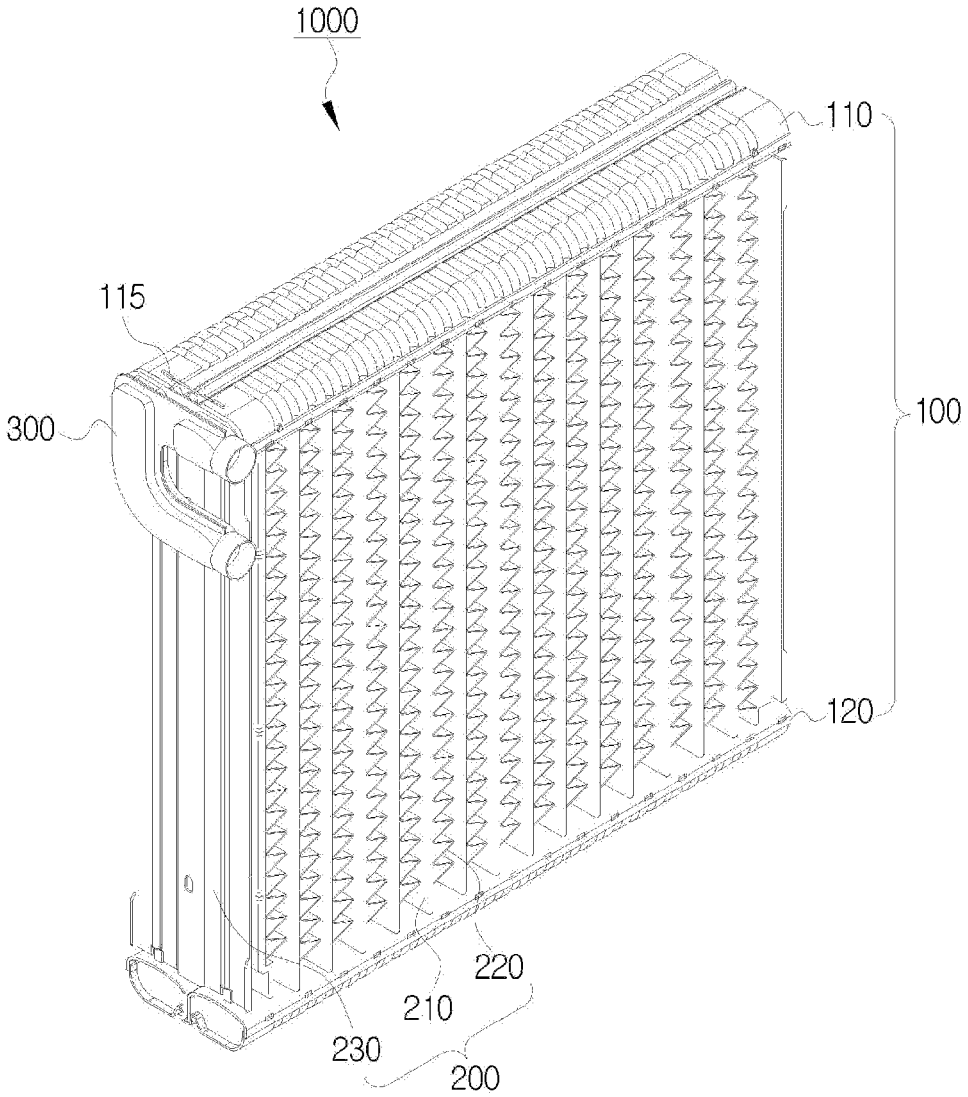
FIG. 2 is a diagram illustrating a heat exchanger according to a first exemplary embodiment of the present invention in a perspective view.
Figure 3:
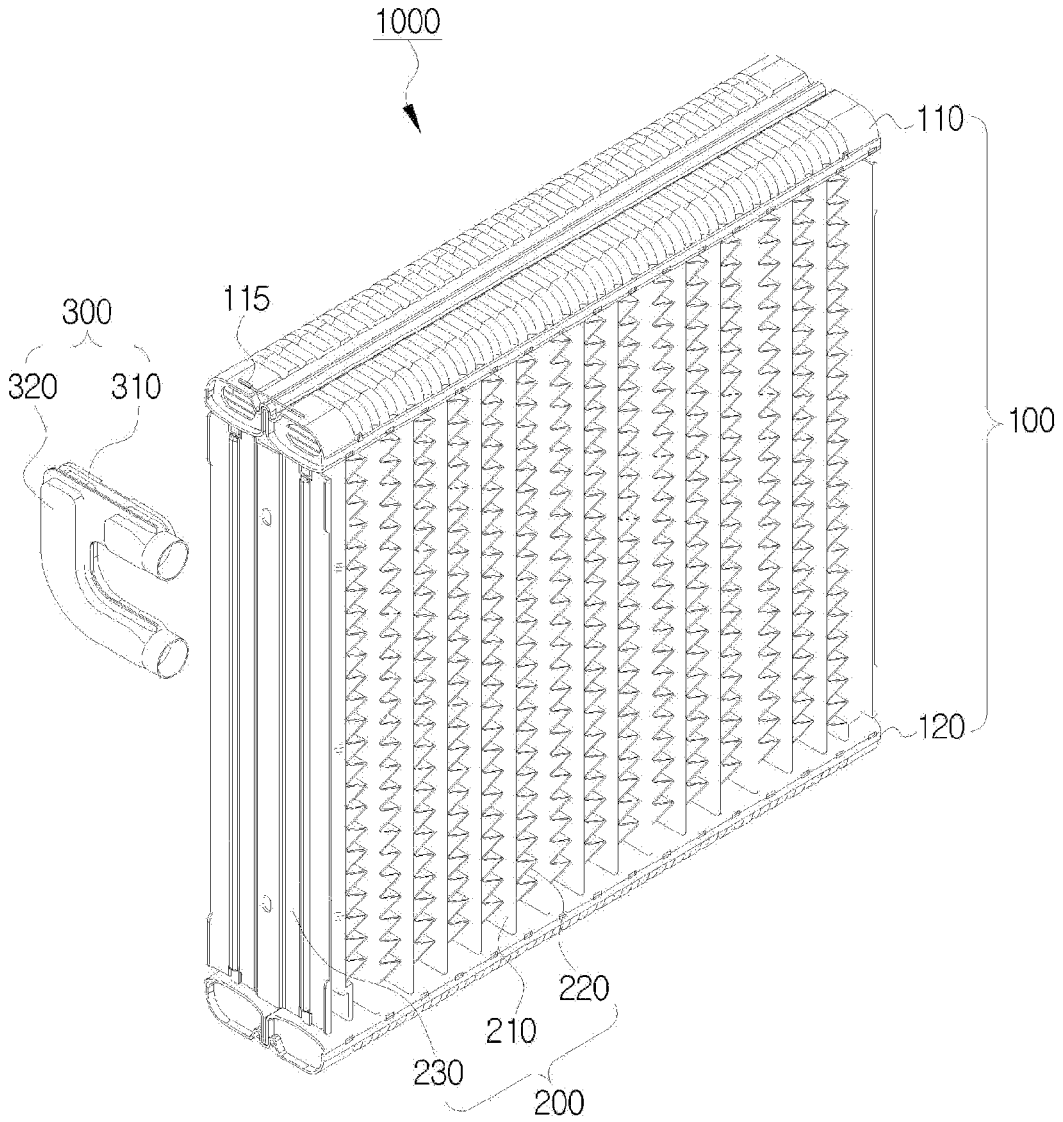
FIG. 3 is another diagram illustrating the heat exchanger according to the first exemplary embodiment of the present invention in a perspective view.
Figure 4:
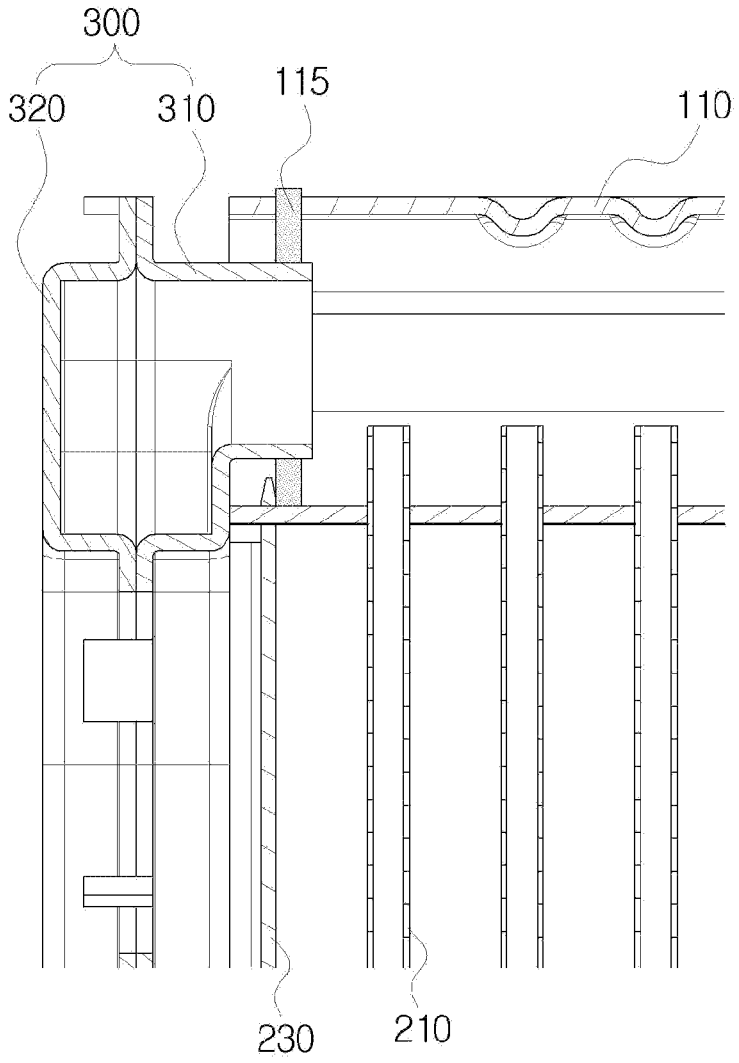
FIG. 4 is a diagram illustrating the heat exchanger according to the first exemplary embodiment of the present invention in a partial cross-sectional view.
Figure 5:
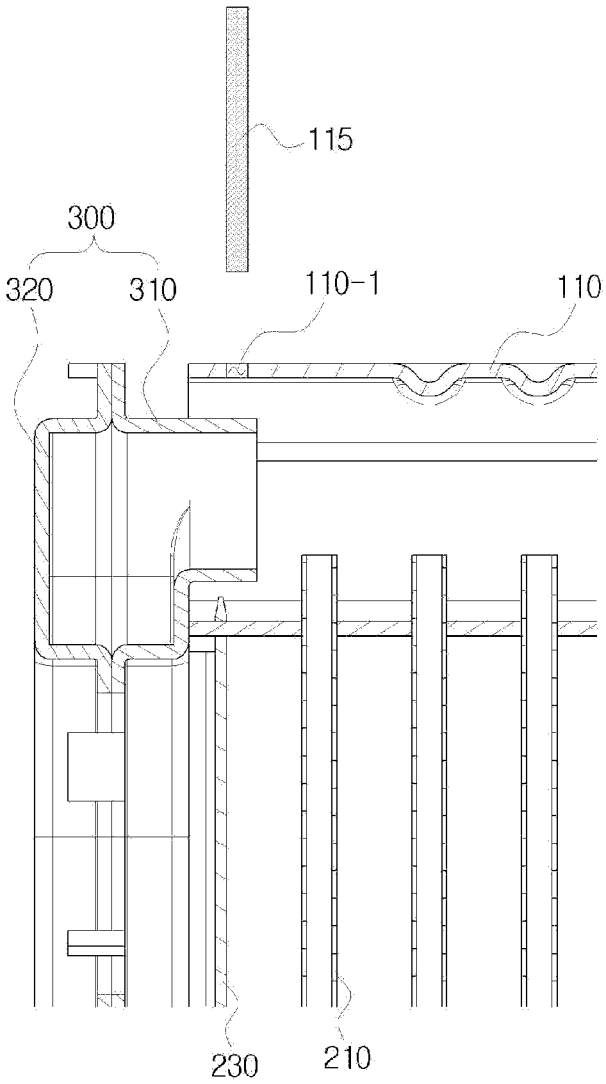
FIG. 5 is another diagram illustrating the heat exchanger according to the first exemplary embodiment of the present invention in a partial cross-sectional view.
Figure 6:
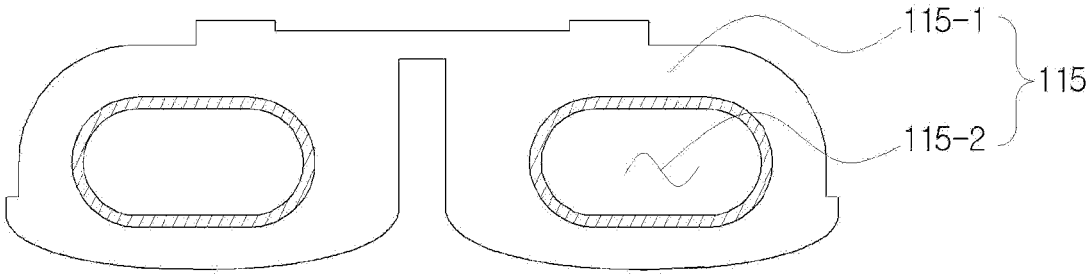
FIG. 6 is a diagram illustrating a fixing baffle of the heat exchanger according to the first exemplary embodiment of the present invention in a cross-sectional view.

FIG. 2 is a diagram illustrating a heat exchanger according to a first exemplary embodiment of the present invention in a perspective view, FIG. 3 is another diagram illustrating the heat exchanger according to the first exemplary embodiment of the present invention in a perspective view, FIG. 4 is a diagram illustrating the heat exchanger according to the first exemplary embodiment of the present invention in a partial cross-sectional view, FIG. 5 is another diagram illustrating the heat exchanger according to the first exemplary embodiment of the present invention in a partial cross-sectional view, and FIG. 6 is a diagram illustrating a fixing baffle of the heat exchanger according to the first exemplary embodiment of the present invention in a cross-sectional view.

Referring to FIGS. 2 to 6, the heat exchanger 1000 according to the first exemplary embodiment of the present invention mainly includes header tanks 100, a core part 200, and a manifold 300. In this case, the header tank 100 includes a fixing baffle 115 formed at one side, in a length direction, of the header tank 100 into which the manifold 300 is inserted and fixed to shield the inside and the outside of the header tank 100.

To describe the heat exchanger 1000 according to the first exemplary embodiment of the present invention as described above in more detail, the header tanks 100 include a first header tank 110 and a second header tank 120. The first header tank 110 and the second header tank 120 are arranged to be spaced apart from each other at a predetermined distance. The first header tank 110 includes a first header and a first tank, and the second header tank 120 includes a second header and a second tank.

The core part 200 includes tubes 210 each having both ends fixed to the first header tank 110 and the second header tank 120, respectively. Through the tubes 210, a heat exchange medium for heat exchange may flow between the first header tank 110 and the second header tank 120. In this case, a plurality of tubes 210 are arranged in the length direction of the header tanks 100, with both ends thereof being inserted and bonded into the first header tank 110 and the second header tank 120, respectively, to be coupled thereto.

In addition, the core part 200 may further include a plurality of fins 220 interposed between the plurality of tubes 210 to improve heat exchange efficiency of the heat exchange medium flowing through the tubes 210.

The manifold 300 is inserted and bonded into the first header tank 110 at one side of the first header tank 110 in the length direction to allow the heat exchange medium to flow into the first header tank 110 from the outside. The manifold 300 mainly includes an insertion portion 310 and a connection portion 320.

The insertion portion 310 is formed to be inserted through and bonded to one side of the first header tank 110 in the length direction, so that the manifold 300 is coupled into the first header tank 110 at one side of first header tank 110 in the length direction. The connection portion 320 is formed such that an end portion of an inlet pipe into which the heat exchange medium is introduced and an end portion of an outlet pipe may be bonded thereto.

The manifold 300 is a known technique and a detailed description thereof is omitted.

The fixing baffle 115 is formed at one side of the first header tank 110 in the length direction so that the insertion portion 310 is inserted and bonded into the first header tank 110 and the fixing baffle 115 is shielded from the outside.

The fixing baffle 115 includes a fixing baffle body 115-1 formed at one side of the first header tank 110 in the length direction to be shielded from the outside and a fixing baffle hole 115-2 formed to be hollow in the fixing baffle body 115-1 in the length direction of the first header tank 110 so that the insertion portion 310 is inserted and bonded into the fixing baffle body 115-1.

The fixing baffle body 115-1 is preferably formed in the same cross-sectional shape as the first header tank 110, which is formed by the first header and the first tank, so that the inside and the outside of the first header tank 110 are shielded from each other, and the fixing baffle hole 115-2 is formed to have an inner diameter corresponding to an outer diameter of the insertion portion 310, thereby preventing leakage of the heat exchange medium even after the insertion portion 310 is inserted and bonded into the fixing baffle hole 115-2.

As described above, the heat exchanger 1000 according to the first exemplary embodiment of the present invention includes the fixing baffle 115 including the fixing baffle body 115-1 having a baffle shape and the fixing baffle hole 115-2 formed to penetrate through the fixing baffle body 115-1 in the length direction of the first header tank 110 to insert and bond an end portion of the insertion portion 310 therethrough. That is, the fixing baffle 115 is formed at one side of the first header tank 110 in the length direction to allow the insertion portion 310 of the manifold 300 to be bonded to one side of the first header tank 110, thereby eliminating a conventional component for inserting and bonding the manifold 300 into the first header tank 110, such as an end cap.

In other words, when compared to the conventional heat exchanger in which the end cap is used to bond the manifold to the first header tank, the heat exchanger 1000 according to the first exemplary embodiment of the present invention is capable of reducing a manufacturing cost and a manufacturing time by eliminating the end cap formed in the length direction of the first header tank 110 and replacing it with the fixing baffle 115 having a simple configuration.

In addition, since the heat exchanger 1000 according to the first exemplary embodiment of the present invention does not require a conventional component such as an end cap, a support 230 may be inserted and fixed into the first header tank 110 on a further outward side in the length direction of the first header tank 110 than the fixing baffle 115.

That is, the support 230 included in the core part 200 may be located on the outermost side in a direction in which the plurality of tubes 210 arranged in the length direction of the header tank 100 are spaced apart from each other, with both ends thereof being coupled to the first header tank 110 and the second header tank 120 respectively, and the support 230 may prevent the tubes 210 from being damaged or deformed from the outside.

In the conventional heat exchanger including a support, the component such as the end cap interferes with the support when the support is coupled to the header tank. For this reason, in the conventional heat exchanger, the support is inserted and fixed into the header tank after an end portion of the support is bent to avoid the end cap.

In contrast, in the heat exchanger 1000 according to the first exemplary embodiment of the present invention, the end cap is eliminated and replaced with the fixing baffle 115 to insert and fix the support 230 into the header tank 100 without changing a shape of the support 230. This makes it possible to reduce a cost and a time for manufacturing the heat exchanger 1000.

In addition, the first header tank 110 of the heat exchanger 1000 according to the first exemplary embodiment of the present invention may include a coupling hole 110-1 formed to penetrate through the first header tank 110 in a direction in which the fixing baffle body 115-1 is inserted into the first header tank 110, so that the fixing baffle body 115-1 is inserted from the outside and bonded to the first header tank 110.

That is, the fixing baffle body 115-1 can be formed in the first header tank 110 in an easier manner by inserting and bonding the fixing baffle body 115-1 into the first header tank 110 from the outside through the coupling hole 110-1 rather than inserting the fixing baffle body 115-1 into the first header tank 110 from the outside in the length direction of the first header tank 110.

The coupling hole 110-1 is preferably formed in a direction in which the first header tank 110 and the second header tank 120 are spaced apart from each other to easily insert and bond the fixing baffle body 115-1, but is not limited thereto. In addition, it is of course required that the coupling hole 110-1 be formed to correspond to a cross section of the fixing baffle body 115-1 to be inserted in order to prevent leakage of the heat exchange medium.

In addition, the fixing baffle body 115-1 is preferably formed to protrude from the coupling hole 110-1 to the outside.

That is, by forming the fixing baffle body 115-1 to protrude from the coupling hole 110-1 to the outside while being inserted and bonded into the first header tank 110 through the coupling hole 110-1, it is possible to not only easily bond the fixing baffle body 115-1 to the first header tank 110 but also recognize a location of the fixing baffle 115 when the insertion portion 310 of the manifold 300 is inserted into the fixing baffle hole 115-2 and bonded to fixing baffle 115, thereby easily inserting and bonding the manifold 300 into the fixing baffle 115.

Second Exemplary Embodiment

Figure 7:
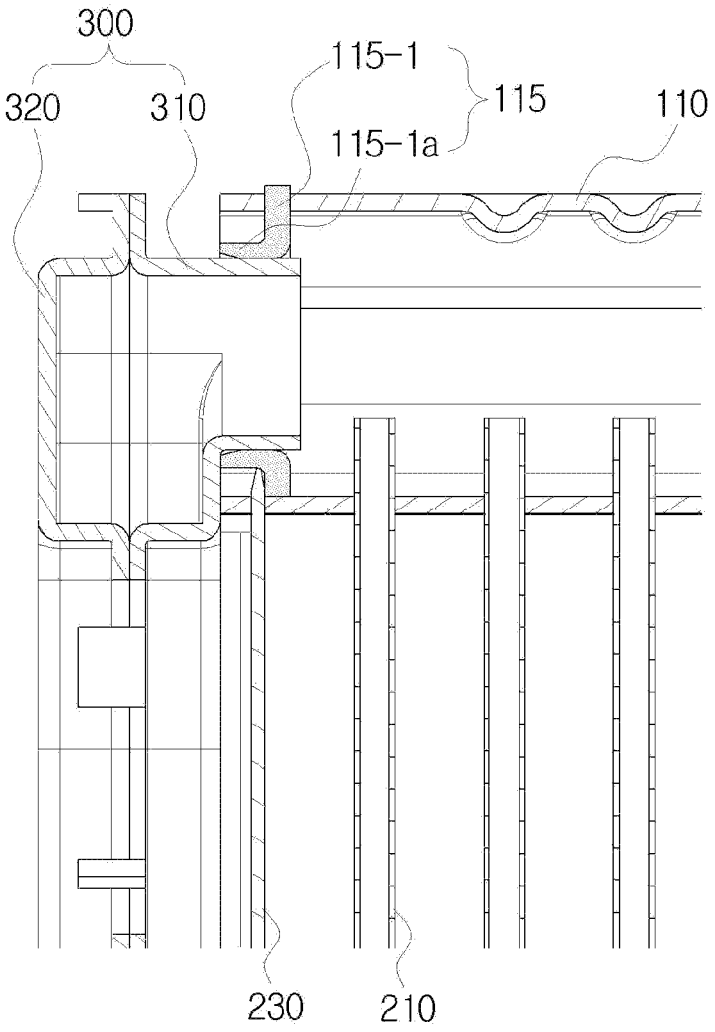
FIG. 7 is a diagram illustrating a heat exchanger according to a second exemplary embodiment of the present invention in a partial cross-sectional view.
Figure 8:
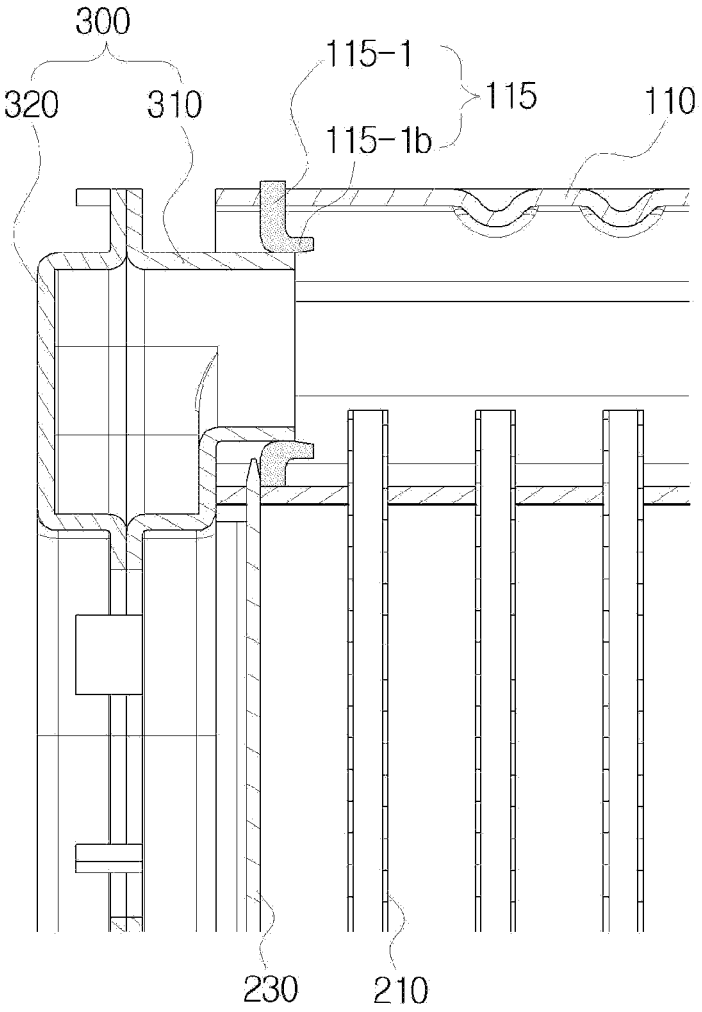
FIG. 8 is another diagram illustrating the heat exchanger according to the second exemplary embodiment of the present invention in a partial cross-sectional view.

FIG. 7 is a diagram illustrating a partial cross-sectional view of a heat exchanger according to a second exemplary embodiment of the present invention, and FIG. 8 is another diagram illustrating a partial cross-sectional view of the heat exchanger according to the second exemplary embodiment of the present invention.

Referring to FIG. 7, the fixing baffle body 151-1 of the heat exchanger 1000 according to the second exemplary embodiment of the present invention further includes a reverse burring portion 151-1*a* formed to extend outwardly from an outer circumference of the fixing baffle hole 151-2 in the length direction of the header tank 100.

The reverse burring portion 115-1*a* is formed to surround the insertion portion 310 of the manifold 300 by protruding outwardly from the outer circumference of the fixing baffle hole 115-2 in the length direction of the header tank 100.

This makes it possible to increase a bonding area between the insertion portion 310 of the manifold 300 and the fixing baffle 115 and increase a bonding force between the manifold 300 and the first header tank 100 accordingly, thereby not only manufacturing the firm heat exchanger 1000 but also preventing the heat exchange medium from being leaked to the outside.

The reverse burring portion 115-1*a* is preferably manufactured by bending the fixing baffle body 115-1 outwardly in the length direction of the header tank 100, but is not limited thereto. The reverse burring portion 115-1*a* may be formed in the fixing baffle 115 in various manners.

In this case, since the reverse burring portion 115-1*a* is formed to extend outwardly in the length direction of the header tank 100, the bonding force with the insertion portion 310 can be increased, but it may be difficult to insert the insertion portion 310 due to the shape of the reverse burring portion 115-1*a* extending outwardly in the length direction of the header tank 100.

To this end, an end portion of the reverse burring portion 115-1*a* may be formed to have an inner diameter gradually increasing toward an edge of the reverse burring portion 115-1*a* so that the inner diameter of the end portion of the reverse burring portion 115-1*a* is larger than the outer diameter of the insertion portion 310. That is, since the inner diameter of the end portion of the reverse burring portion 115-1*a* gradually increases toward the edge of the reverse burring portion 115-1*a*, the insertion portion 310 can be easily inserted by guiding the insertion portion 310 when inserted into the first header tank 110, and the manifold 300 can be inserted to an accurate depth into the first header tank 110.

In another exemplary embodiment, the reverse burring portion 115-1*a* may be formed to be curved in the direction in which the header tanks 100 are spaced apart from each other so that the inner diameter of the end portion of the reverse burring portion 115-1*a* is larger than the outer diameter of the insertion portion 310.

That is, since the end portion of the reverse burring portion 115-1*a* is formed to be curved in the direction in which the header tanks 100, i.e. the first header tank 110 and the second header tank 120, are spaced apart from each other, the inner diameter of the end portion of the reverse burring portion 115-1*a* is larger than the outer diameter of the insertion portion 310, thereby easily inserting the insertion portion 310.

In addition, in the heat exchanger 1000 including the fixing baffle 115 including the reverse burring portion 115-1*a*, the fixing baffle hole 115-2 may be formed to have a larger inner diameter on an inward side than on an outward side in the length direction of the header tank 100.

That is, since the fixing baffle hole 115-2 is formed to have a larger inner diameter on the inward side than on the outward side in the length direction of the header tank 100, when the insertion portion 310 is bonded to the fixing baffle 115 after being inserted into the fixing baffle 115, the bonding between the fixing baffle body 151-1 and the insertion portion 310 can be easily performed.

In other words, since the inner diameter of the fixing baffle hole 115-2 on the outward side in the length direction of the header tank 100 is identical to the outer diameter of the insertion portion 310, a gap therebetween can be prevented, and since the fixing baffle hole 115-2 is formed to have a larger inner diameter on the inward side than on the outward side in the length direction of the header tank 100, a brazing process or the like can be facilitated through a space secured therefrom.

Referring to FIG. 8, the fixing baffle body 115-1 of the heat exchanger 1000 according to the second exemplary embodiment of the present invention may include a forward burring portion 151-1*b* formed to extend outwardly from the outer circumference of the fixing baffle hole 115-2 in the length direction of the header tank 100.

Like the reverse burring portion 115-1*a*, the forward burring portion 115-1*b* is formed to surround the insertion portion 310 of the manifold 300 by protruding inwardly from the outer circumference of the fixing baffle hole 115-2 in the length direction of the header tank 100.

This makes it possible to increase a bonding area between the insertion portion 310 of the manifold 300 and the fixing baffle 115 and increase a bonding force between the manifold 300 and the first header tank 100 accordingly, thereby not only manufacturing the firm heat exchanger 1000 but also preventing the heat exchange medium from being leaked to the outside.

Like the reverse burring portion 115-1*a*, the forward burring portion 115-1*b* is preferably manufactured by bending the fixing baffle body 115-1 inwardly in the length direction of the header tank 100, but is not limited thereto. The forward burring portion 115-1*b* may be formed in the fixing baffle 115 in various manners.

In this case, since the forward burring portion 115-1*b* is formed to extend inwardly in the length direction of the header tank 100, the bonding force with the insertion portion 310 can be increased, but it may be difficult to insert the insertion portion 310 due to the shape of the forward burring portion 115-1*b* extending inwardly in the length direction of the header tank 100.

To this end, in the heat exchanger 1000 including the fixing baffle 115 including the forward burring portion 115-1*b*, the fixing baffle hole 115-2 may be formed to have a larger inner diameter on an outward side than on an inward side in the length direction of the header tank 100.

That is, since the fixing baffle hole 115-2 is formed to have a larger inner diameter on the outward side than on the inward side in the length direction of the header tank 100, this may function as a guide when the insertion portion 310 is inserted, thereby not only easily inserting the insertion portion 310 but also enhancing convenience in performing a bonding process such as a brazing process through a secured space.

In addition, an end portion of the forward burring portion 115-1*b* may be formed to have an inner diameter gradually increasing toward an edge of the forward burring portion 115-1*b* so that the inner diameter of the end portion of the forward burring portion 115-1*b* is larger than the outer diameter of the insertion portion 310. In another exemplary embodiment, the forward burring portion 115-1*b* may be formed to be curved in the direction in which the header tanks 100 are spaced apart from each other so that the inner diameter of the end portion of the forward burring portion 115-1*b* is larger than the outer diameter of the insertion portion 310.

That is, since the end portion of the forward burring portion 115-1*b* is formed to have an inner diameter of gradually increasing toward the edge of the forward burring portion 115-1*b* or formed to be curved in the direction in which the header tanks 100 are spaced apart from each other, the inner diameter of the end portion of the forward burring portion 115-1*b* is larger than the outer diameter of the insertion portion 310, thereby easily performing a bonding process for coupling the manifold 300 to the first header tank 100 after the insertion portion 310 is inserted thereinto.

As described above, in the heat exchanger 1000 according to the second exemplary embodiment of the present invention, the fixing baffle 115 including the reverse burring portion 115-1*a* or the fixing baffle 115 including the forward burring portion 115-1*b* may be provided depending on the configuration of the header tank 100 and the manifold 300. In addition, the heat exchanger 1000 according to the second exemplary embodiment of the present invention may be implemented in various manners, for example in such a manner that the fixing baffle 115 includes both the reverse burring portion 115-1*a* and the forward burring portion 115-1*b*.

DESCRIPTION OF REFERENCE NUMERALS

1000: heat exchanger
100: header tank
110: first header tank
110-1: coupling hole
115: fixing baffle
115-1: fixing baffle body
115-1*a*: reverse burring portion
115-1*b*: forward burring portion
115-2: fixing baffle hole
120: second header tank
200: core part
210: tube
220: fin
230: support
300: manifold
310: insertion portion
320: connection portion

The invention claimed is:

1. A heat exchanger comprising:

header tanks including a first header tank and a second header tank spaced apart from each other at a predetermined distance;

a core part including tubes each having both ends fixed to the first header tank and the second header tank respectively; and a manifold including an insertion portion inserted into the first header tank at one side of the first header tank in a length direction and a connection portion bonded to end portions of an inlet pipe and an outlet pipe through which a heat exchange medium is introduced and discharged respectively, wherein the first header tank includes a fixing baffle formed at one side of the first header tank in the length direction, and configured to shield one open side of the first header tank, the fixing baffle includes a fixing baffle body for shielding one open side of the first header tank, and a fixing baffle hole formed to be hollow in the fixing baffle body, the insertion portion of the manifold is inserted and bonded into the fixing baffle hole of the fixing baffle, so that the manifold is coupled to one side of the first header tank in the length direction, the core part further includes a support disposed on an outermost side in a direction in which the tubes are arranged, and inserted and coupled into the header tanks, the support is inserted and fixed into the header tanks on a further outward side in the length direction of the header tank than the fixing baffle, and the support is disposed between the manifold and the fixing baffle.

2. The heat exchanger of claim 1, wherein the first header tank further includes a coupling hole formed to penetrate through the first header tank so that the fixing baffle body is inserted and bonded into the first header tank.

3. The heat exchanger of claim 2, wherein the coupling hole is formed in a direction in which the header tanks are spaced apart from each other.

4. The heat exchanger of claim 2, wherein at least a portion of the fixing baffle body is configured to protrude outside the first header tank by being penetrated through the coupling hole.

5. The heat exchanger of claim 1, wherein the fixing baffle body further includes a reverse burring portion formed to extend outwardly from an outer circumference of the fixing baffle hole in the length direction of the header tank.

6. The heat exchanger of claim 5, wherein an end portion of the reverse burring portion is formed to be curved in a direction in which the header tanks are spaced apart from each other so that an inner diameter of the end portion of the reverse burring portion is larger than an outer diameter of the insertion portion.

7. The heat exchanger of claim 5, wherein the fixing baffle hole is formed to have a larger inner diameter on an inward side than on an outward side in the length direction of the header tank.

8. The heat exchanger of claim 1, wherein the fixing baffle body further includes a forward burring portion formed to extend inwardly from an outer circumference of the fixing baffle hole in the length direction of the header tank.

9. The heat exchanger of claim 8, wherein the fixing baffle hole is formed to have a larger inner diameter on an outward side than on an inward side in the length direction of the header tank.

10. The heat exchanger of claim 8, wherein an end portion of the forward burring portion is formed to be curved in a direction in which the header tanks are spaced apart from each other so that an inner diameter of the end portion of the forward burring portion is larger than an outer diameter of the insertion portion.

* * * * *